United States Patent [19]

Calvino

[11] 4,443,674

[45] Apr. 17, 1984

[54] CIRCUIT INTERRUPTER CLOSING RESISTANCE MECHANISM

[75] Inventor: Ben J. Calvino, Monroeville, Pa.

[73] Assignee: Westinghouse Electric Corp., Pittsburgh, Pa.

[21] Appl. No.: 364,038

[22] Filed: Mar. 31, 1982

[51] Int. Cl.[3] ..... H01H 33/16

[52] U.S. Cl. ..... 200/144 AP; 200/145

[58] Field of Search ..... 200/145, 144 AP, 148 F, 200/148 D

[56] References Cited

U.S. PATENT DOCUMENTS

| | | | |
|---|---|---|---|
| 4,009,458 | 2/1977 | Kishi et al. | 200/144 AP |
| 4,250,362 | 2/1981 | Cookson | 200/144 AP |
| 4,263,490 | 4/1981 | Pham Van | 200/144 AP |
| 4,306,263 | 12/1981 | Gray et al. | 200/144 AP |
| 4,365,126 | 12/1982 | Oshima et al. | 200/144 AP |

FOREIGN PATENT DOCUMENTS

| | | | |
|---|---|---|---|
| 2949753 | 6/1981 | Fed. Rep. of Germany | 200/145 |
| 2047001 | 11/1980 | United Kingdom | 200/145 |

*Primary Examiner*—Robert S. Macon

[57] ABSTRACT

A power circuit interrupter having novel mechanical timing means for precision control of the insertion and removal of a resistance or other impedance means in parallel with the interrupter contacts at predetermined time intervals. The mechanical timing means has rigid mechanical operating elements for precise, accurate and repeatable operating characteristics.

10 Claims, 13 Drawing Figures

FIG.4
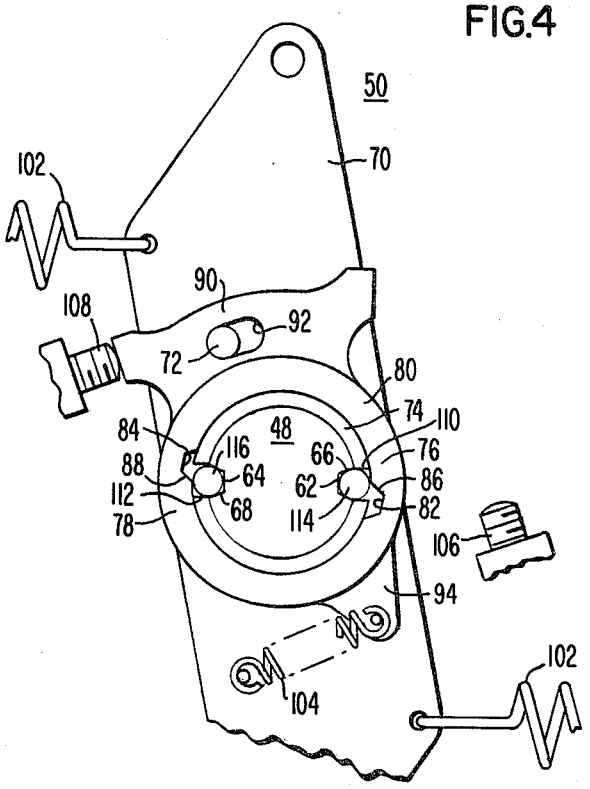
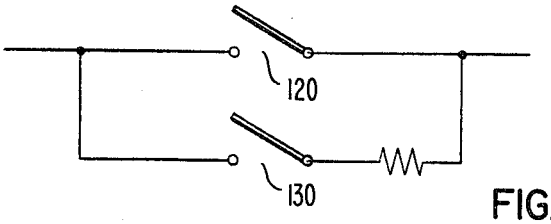
FIG.4A

FIG.5
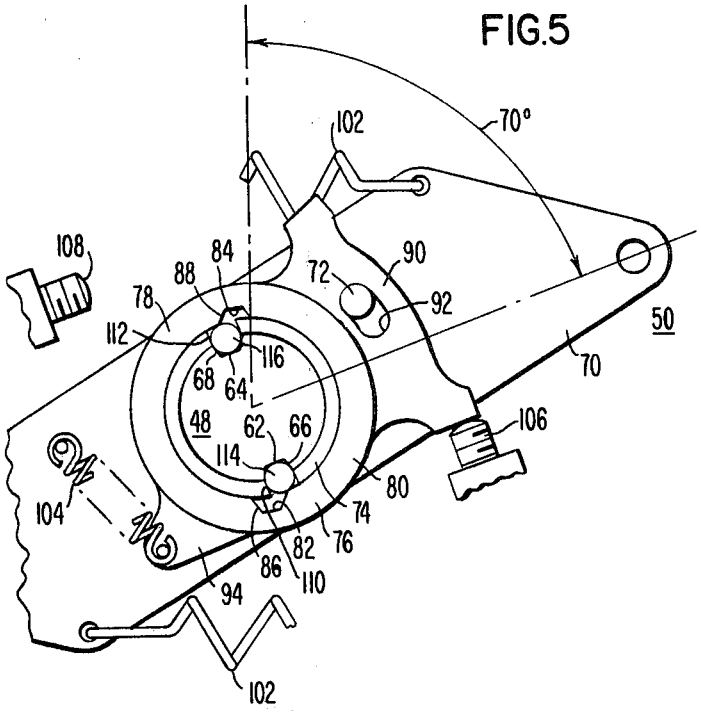
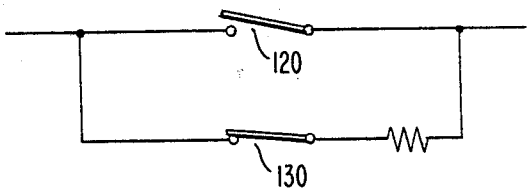
FIG.5A

CIRCUIT INTERRUPTER CLOSING RESISTANCE MECHANISM

BACKGROUND OF THE INVENTION

1. Field of the Invention

The invention relates generally to circuit interrupters utilizing closing resistance and more particularly to a high voltage circuit interrupter having a precise repeatable closing mechanism utilized to insert a closing resistance in parallel with the main contacts of the circuit interrupter.

2. Description of the Prior Art

It is known that high voltage surges, depending upon circuit conditions, can occur during the closing of the contacts of a high voltage circuit interrupter. One method of reducing such high switching surges is described in U.S. Pat. No. 3,291,947, where a resistance is inserted into the contacts of the circuit interrupter prior to the time of engagement of the main contacts. U.S. Pat. No. 4,072,836 also discloses the use of a resistor inserted into the circuit during the closing operation of a high voltage circuit interrupter.

When interrupting very high voltages, for example, 500 kV, it is not uncommon to utilize two or more individual interrupting heads serially connected to provide the necessary interrupting capacity. This use of multiple interrupting heads can cause coordination problems, particularly with respect to closing on an energized transmission line. This is particularly critical for the insertion of the resistors into the circuit. For correct operation of the resistor insertion scheme, it is essential that the impedance contacts within all the interrupting units close a very short time, for example, 10 milliseconds, before the closing of the main circuit breaker interrupter contacts. During the opening operation of the circuit breaker, however, such closing resistances are not inserted into the circuit, and have no function whatsoever as set forth in U.S. Pat. No. 3,291,947. It is therefore necessary that the impedance contacts open within a few milliseconds after the interrupter contacts are closed. Accordingly, it would be desirable to have a closing resistor insertion mechanism that is characterized by precise repeatability and that is able with a common movement effecting means to close the impedance resistor contacts shortly before the closing of the main circuit breaker interrupter contacts, for example, 10 milliseconds before, and to open them a few milliseconds after the main interrupter contacts are closed.

Some mechanisms for the closing resistor insertion depend upon springs or other variable devices whose characteristics may change after multiple operations. Accordingly, it would also be desirable if the resistor insertion timing mechanism had a rigid mechanical arrangement for at least the insertion operation since this is the operation that must be controlled precisely.

SUMMARY OF THE INVENTION

Briefly, the present invention comprises a power circuit interrupter having a novel mechanical timing means for precision control of the closing of a pair of cooperable, separable impedance contacts used for placing a resistance or other impedance means in parallel with the cooperable, separable main interrupter contacts of the circuit interrupter at a predetermined time interval shortly before the closing of the interrupter contacts and to reopen the impedance contacts shortly thereafter. The mechanical timing means according to the teachings of the invention has rigid cooperative mechanical elements that are responsive to movement of the movement effecting means for effecting movement of the separable interrupter and impedance contacts of the power circuit interrupter. The cooperating mechanical elements link and transfer movement between the movement effecting means of the power circuit interrupter and an impedance contact mechanism which is used for closing and reopening of the pair of cooperable, separable impedance contacts. The rigid mechanical elements of the mechanical timing means are disposed on and rotate in conjunction with and relative to a shaft of the movement effecting means which has at least a first aperture; and comprise a driving lever having a cylindrical protrusion with at least a second aperture disposed within the protrusion, a freewheel cam rotatably disposed upon the cylindrical protrusion of the driving lever having a third aperture disposed therein. The movement effecting means shaft, driving lever and freewheel cam are arranged in coaxial relationship with the first, second and third apertures situated within a common plane so as to form a radial passageway when the first, second and third apertures are radially aligned, with a free roller disposed within the radial passageway. The driving lever of the mechanical timing means is rigidly linked and transfers movement to the impedance contact mechanism and is biased by a first biasing means in the direction which opens the impedance contacts, and the freewheel cam is biased in the opposite direction by a second biasing means. When the movement effecting means shaft rotates to close the pair of cooperable, separable interrupter contacts, the movement effecting means shaft, driving lever and freewheel cam cooperate with the free roller (which is controlled by the freewheel cam) to cause the driving lever to close the pair of cooperable, separable impedance contacts a predetermined time interval before the interrupter contacts close. Due to the bias of the first biasing means, the movement effecting means shaft, driving lever and freewheel cam cooperate with the free roller (which again is controlled by the freewheel cam) to cause the driving lever to reopen the pair of cooperable, separable impedance contacts after the interrupter contacts close.

BRIEF DESCRIPTION OF THE DRAWINGS

The invention may be understood, and further advantages and uses thereof more readily apparent, when considered in view of the following detailed description of exemplary embodiments, taken with the accompanying drawings in which:

FIG. 4 is an enlarged elevational view of the mechanical timing means and associated movement effecting means shaft of FIG. 3 showing the driving lever in the vertical position;

FIG. 4A is a schematic diagram showing the positions of the main contacts and the impedance contacts corresponding to the position of the mechanical timing means of FIG. 4;

FIG. 5 is an enlarged elevational view of the mechanical timing means of FIG. 3 shown when the movement effecting means shaft is rotated clockwise during the main contact closing operation, where the driving lever has advanced 70°;

FIG. 5A is a schematic diagram showing the positions of the main contacts and impedance contacts corresponding to the position of the mechanical timing means of FIG. 5;

FIG. 6 is an enlarged elevational view of the mechanical timing means of FIG. 3 when the movement effecting means shaft has rotated further in the clockwise position during the interrupter main contact closing operation, showing the driving lever in an 80° advanced rotated position;

DESCRIPTION OF THE PREFERRED EMBODIMENT

Figure 1:
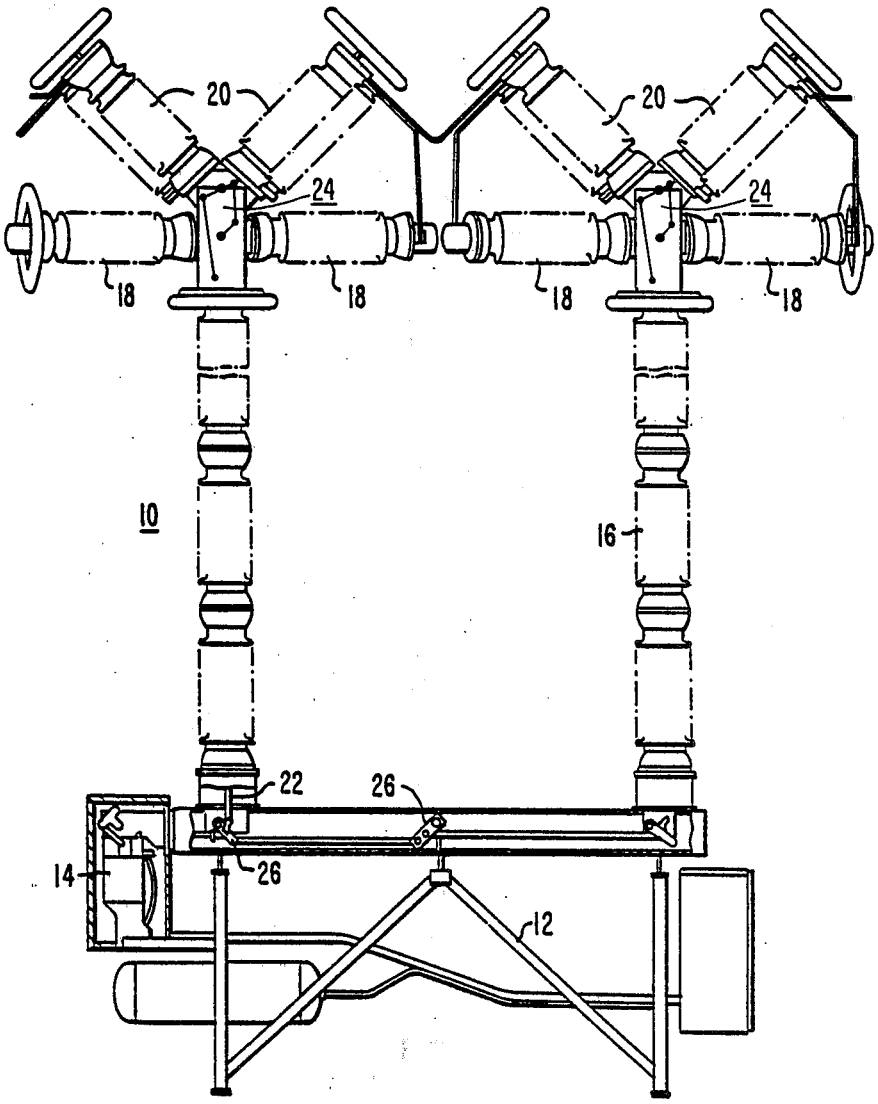
FIG. 1 is an elevational view of a puffer type compressed gas power circuit breaker constructed according to the teachings of the present invention.

Referring now to the drawings, in FIG. 1 there is shown an elevational view of a puffer type compressed gas power circuit breaker constructed according to the teachings of the invention. Power circuit breaker 10 includes breaker frame 12 which supports operating mechanism 14 and porcelain support columns 16 which insulate and support closing resistor modules 18 and interrupting modules 20. Within each porcelain support column 16 a glass epoxy column operating rod 22 connects interrupter and closing resistor external linkage 24 (shown in FIG. 2) to the interrupter linkage 26 which is connected to and operated by operating mechanism 14.

Figure 2:
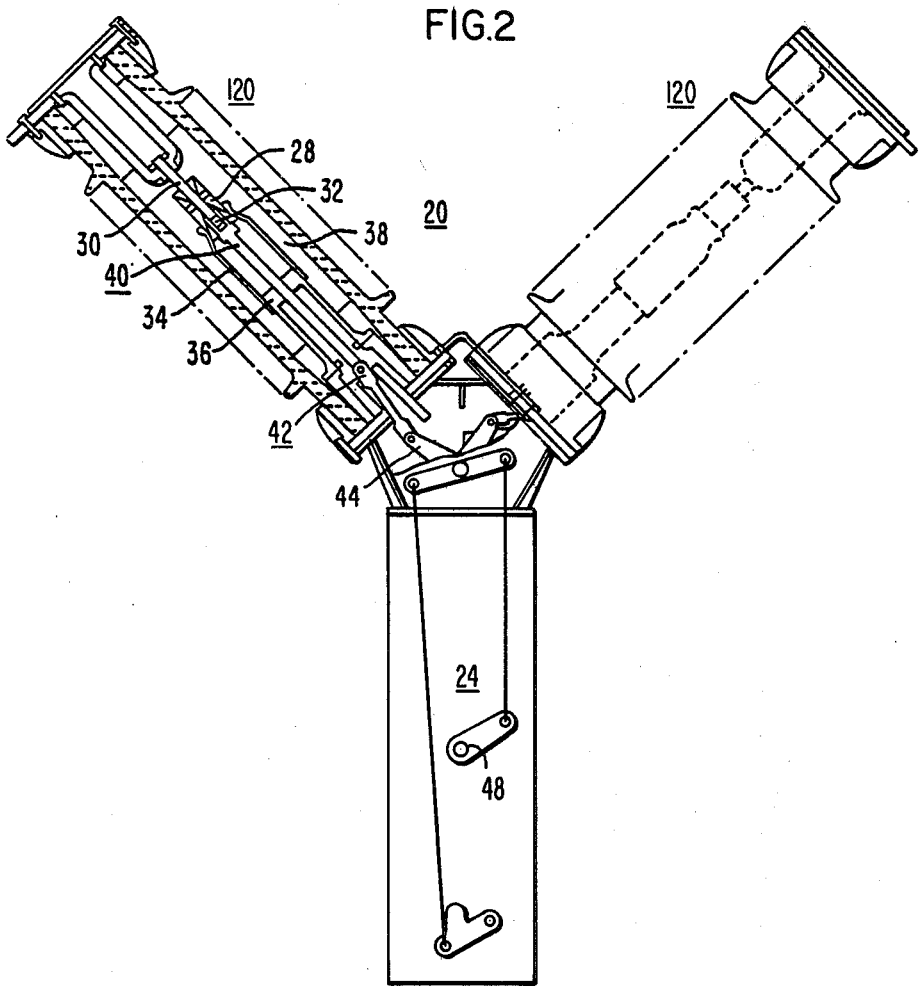
FIG. 2 is an elevational view, with parts broken away, of the circuit breaker interrupter module of FIG. 1 and portions of the movement effecting means and the main contact operating mechanism of the circuit interrupter, the breaker contacts being illustrated in the closed circuit position.

Referring now to FIG. 2, as is well known to those skilled in the art interrupting modules 20 include an arc chamber 28, a stationary contact 30, a moving contact 32, a moving puffer cylinder 34, a stationary piston 36 and an insulating gas medium 38 such as sulfur hexafluoride gas. In operation the sulfur hexafluoride insulating gas pressure required to interrupt the arc is generated by operating the moving contact assembly 40. No additional moving parts or valves are required. With the breaker closed, the insulating sulpha hexafluoride gas pressures inside and outside the moving contact cylinder 34 are identical. When the contacts (stationary and moving) part, the resulting arc limits the flow of sulpha hexafluoride gas out of the puffer cylinder 34. The movement of the puffer cylinder 34 generates gas pressure inside the cylinder between the arc and the stationary piston 36 creating an axial flow of compressed sulfur hexafluoride gas which sweeps away the hot arc gases, stretching, cooling and extinguishing the arc. At the end of this sequence of events, the sulpha hexafluoride gas reverts to the single, low pressure state ready for the next operation.

Applications which more fully describe in detail the operation of puffer-type circuit interrupters are: U.S. Pat. No. 4,095,068 issued June 13, 1978 to Jeffrey R. Myer et al.; U.S. Pat. No. 4,101,748 issued July 18, 1978 to Jeffrey R. Myer et al; and U.S. patent application Ser. No. 685,826 by Willie B. Freeman et al. all assigned to the assignee of the instant patent application. Generally, the operation of such a puffer type circuit interrupter, such as interrupter 20 involves the opening and closing movements of a pair of movable contacts, such as contact 32 from a pair of cooperable stationary contacts, such as contact 30 together with the compression of an insulating gas 38 between the movable cylinder 34 and the cooperating, stationary fixed piston structure 36 of a puffer assembly.

Although the teachings of the invention are applicable to any type of circuit breaker construction, such as an oil type, air type, a vacuum type, or of variant different type, nevertheless, for purposes of illustration only, a compressed gas power circuit breaker 10 of the so called puffer type is illustrated in FIG. 1. The present invention is more particularly concerned with mechanical timing means for operating the closing impedance modules 18 as briefly described above. A circuit interrupter application is illustrated because the present invention solved certain problems relative to precise control of the closing of the impedance contacts within the resistor modules 18. The invention, however, is broadly applicable to other and widely different types of apparatus wherein precise, repeatable timing control utilizing exclusively rigid mechanical linkages is desired. As will be developed hereinafter within this description of the preferred embodiments, the mechanical timing means of the invention does not include any electrical operators, springs, or other resilient operators, or any other operators whose characteristics may fluctuate either immediately or after prolonged usage. In this way the control provided by the mechanical timing means according to the teachings of the invention is precise, accurate and most importantly repeatable, i.e., will function as precise and accurate on the infinite operation as on the first operation.

Figure 3:
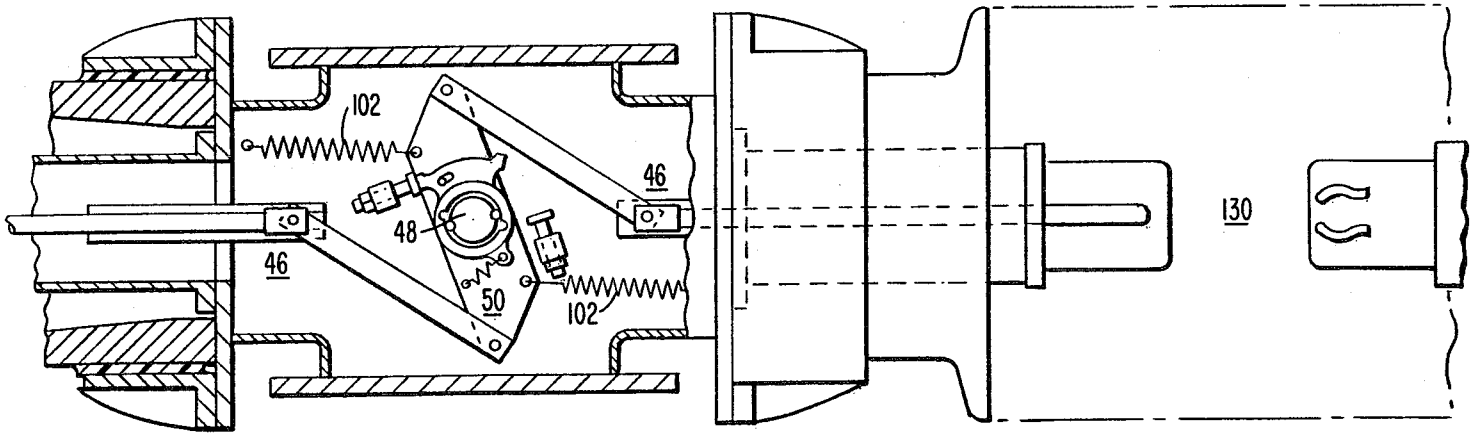
FIG. 3 is an enlarged cross sectional view of portions of the impedance modules of FIG. 1 showing in elevation the impedance contact mechanism, mechanical timing means and the associated shaft of the movement effecting means of the circuit interrupter.

As illustrated in FIGS. 1, 2 and 3, there are essentially three main operating components necessary for the operation of the interrupter and resistor modules of power circuit interrupter 10; a movement effecting means, an interrupter contact mechanism, and an impedance contact mechanism. Pneumatic operating mechanism 14, interrupter linkage 26, glass epoxy column operating rod 22 and interrupter and closing resistor external linkage 24, comprise movement effecting means 40 for effecting movement and operation of the interrupter contacts and the impedance contacts for operation of power circuit interrupter 10. Movement effecting means 40 interfaces with interrupter contact operating mechanism 42 by means of interrupter module rotating phase lever system 44 (shown in FIG. 2) and with impedance contact operating mechanism 46 and mechanical timing means 50 (shown in FIG. 3) by means of shaft 48 shown in FIGS. 2 and 3.

Referring now to FIGS. 3 and 4 and in particulin FIG. 4 there is shown an enlarged elevational view of mechanical timing means 50, when the interrupter contacts and the impedance contacts are both open before the movement effecting means, through shaft 48, has started a closing operation. Mechanical timing means 50 includes first and second movement effecting means shaft apertures 62 and 64, respectively, each having a first transverse side 66 and 68, respectively, disposed within the periphery of shaft 48. Mechanical timing means 50 further includes driving lever 70 having a freewheel cam restraining pin 72 and a driving lever cylindrical protrusion 74 disposed thereon with first and second driving lever apertures 76 and 78 disposed within driving lever cylindrical protrusion 74, respectively. Mechanical timing means 50 further includes a free wheel cam 80 having first and second free wheel apertures 82 and 84 with transverse sides 86 and 88, respectively, a restraining appendage 90 with a restraining aperture 92 disposed therein and a biasing hanger 94. Mechanical timing means 50 further includes driving lever biasing means 102 which may be, for example, a pair of helical return springs as used in the preferred embodiment in FIGS. 3 and 4, a free wheel cam biasing means 104 which may be, for example, a resetting spring extending between free wheel cam biasing hanger 94 and a pin disposed upon driving lever 70 as used in the preferred embodiment shown in FIGS. 3 and 4, and first and second free wheel cam stopping means 106, 108, respectively, which may be for example adjustable machine screws mounted within closing resistor module 18. Driving lever 70 is rotatably disposed upon movement effecting means shaft 48 and free wheel cam 80 is rotatably disposed upon driving lever cylindrical protrusion 74 such that the first and second apertures, respectively, of movement effecting means shaft 48, driving lever 70, and free wheel cam 80 are situated within a common plane so as to form first and second free roller radial passageways 110 and 112, respectively, when the first and second apertures of movement effecting means shaft, driving lever and free wheel cams 62, 76, 82 and 64, 78, 84, respectively, are radially aligned. First and second free rollers 114, 116 are disposed within first and second radial passages 110, 112, respectively. Driving lever biasing means 102 acts to rotate driving lever 70 in the counterclockwise direction and free wheel cam biasing means 104 acts to rotate free wheel cam 80 in the clockwise direction relative to driving lever 70.

FIGS. 4 through 8 represent mechanical timing means 50 in various positions corresponding to the positions of cooperable, separable interrupter contacts 120 and cooperable, separable impedance contacts 130 shown in schematic diagrams 4A through 8A, respectively. Cooperable,separable interrupter contacts 120 and cooperable, separable impedance contacts 130 are also identified on FIGS. 2 and 3, respectively. Accordingly, similar elements of mechanical timing means 50 in FIGS. 3 through 8 are identified with similar numerals and of course the interrupter contacts and impedance contacts shown in FIGS. 2 and 3, respectively, as well as in FIGS. 4A through 8A are denoted by the numerals 120 and 130, respectively.

Referring again to FIG. 4 there is shown mechanical timing means 50 when both the interrupter contacts and the impedance contacts are open as shown in FIG. 4A. In operation, when movement effecting means 46 begins to move to close interrupter contacts 120, movement effecting means shaft 48 rotates in the clockwise direction, and free rollers 114 and 116, respectively, restrained by free wheel cam 80 act to latch driving lever cylindrical protrusion 74 and thereby driving lever 70 with shaft 48, thereby causing driver lever 70 to rotate simultaneously with shaft 48 in the clockwise direction and charge the driving lever biasing means or helical springs 102. Free wheel cam 80 also rotates in the clockwise direction under the influence of freewheel cam biasing means 104.

Referring now to FIGS. 5 and 5A there is shown the position of the contacts (both interrupter and impedance) and the position of the mechanical timing means 50 after the driving lever 70 and free wheel cam 80 have rotated in unison with shaft 48 approximately 70° in the clockwise direction and charged the driving lever biasing means 102. Free wheel cam 80 stops rotating in the clockwise direction when restraining appendage 90 comes in contact with first stopping means 106. As shown in FIG. 5A, the 70° clockwise rotation of driver lever 70 has caused impedance contact mechanism 46 to close impedance contacts 130 approximately 10 milliseconds before interrupter contacts 120 close during the closing operation of the circuit interrupter 10.

Figure 6A:
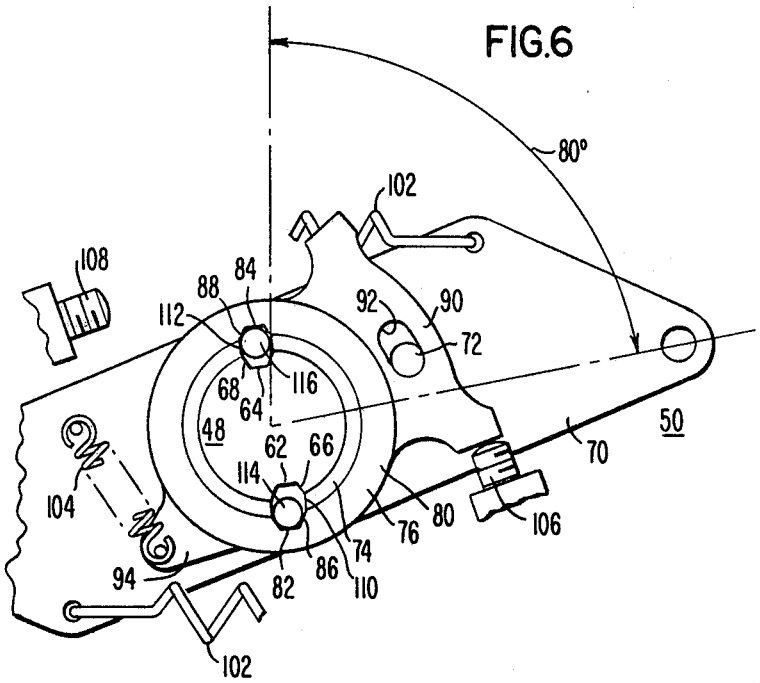
FIG. 6A is a schematic diagram showing the positions of the main and impedance contacts corresponding to the position of the mechanical timing means of FIG. 6.
Figure 6A:
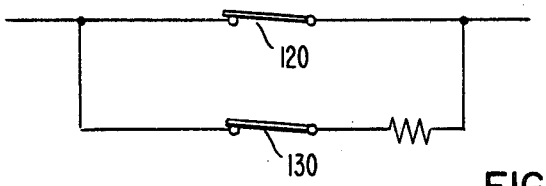

Referring now to FIGS. 6 and 6A, it can be seen that driving lever 70, linked to shaft 48 by free rollers 114 and 116, respectively, continues to rotate in the clockwise direction ten more degrees to 80° clockwise rotation thereby charging freewheel biasing means 104 and further charging driving lever biasing means 102 thus closing interrupter contacts 120 and advancing driving lever restraining pin 72 to the most forward clockwise position within restraining aperture 92 because free wheel cam 80 is restrained by first stopping means 106. Since free wheel cam 80 is restrained from forward movement in the clockwise direction by first stopping means 106 first and second free wheel apertures 82 and 84 are also aligned with first and second shaft apertures 62 and 64 and first and second driving lever apertures 76 and 78, respectively, thereby completing free roller radial passageways 110 and 112, respectively, and first and second free rollers 114 and 116, respectively, are forced into linking driving lever cylindrical protrusion 74 and thereby driving lever 70 with free wheel cam 80 by means of transverse sides 66 and 68 of first and second shaft apertures 62 and 64, respectively. Now driving lever 70 is free to rotate in the counterclockwise direction (due to the influence of driving lever biasing means 102) and free rollers 114 and 116, respectively, are restrained into linking driving lever 70 with free wheel cam 80 by the periphery of shaft 48 (see FIG. 7).

Figure 7:
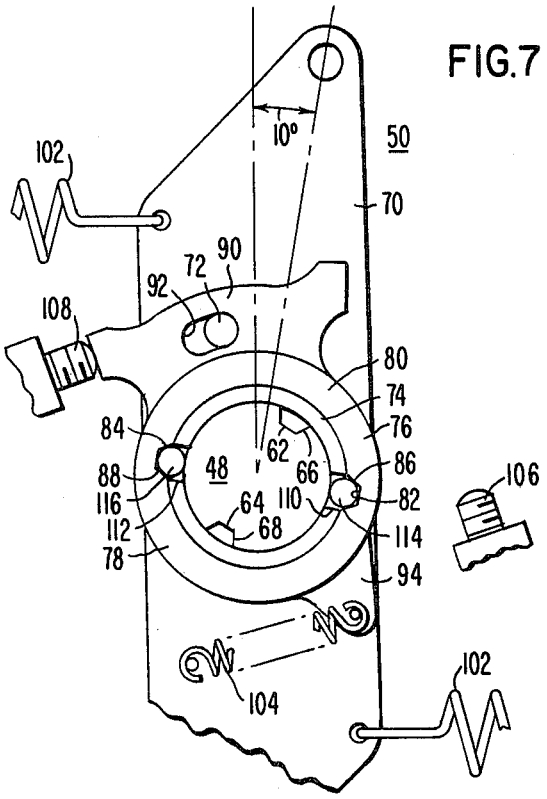
FIG. 7 is an enlarged elevational view of the mechanical timing means of FIG. 3 when the movement effecting means shaft has rotated clockwise to the furtherest position during the interrupter main contact closing operation and the driving lever has released and returned to a 10° clockwise rotated position.
Figure 7A:
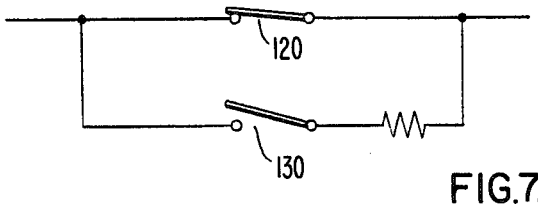
FIG. 7A is a schematic diagram showing the position of the main and impedance contacts corresponding to the position of the mechanical timing means of FIG. 7.

As shown in FIGS. 7 and 7A, due to the influence of charged driving lever biasing means 102, the driving lever 70 and rigidly linked free wheel cam 80 together with the first and second free rollers 114 and 116, respectively, have rotated 70° in the counterclockwise direction. They return to a 10° clockwise position because of the restraining action of second stopping means 108 upon restraining appendage 90 of free wheel cam 80. The 70° counterclockwise rotation of driving lever 70 as shown in FIG. 7A causes impedance contact mechanism 46 to reopen impedance contacts 130 a few milliseconds after interrupter contacts 120 have closed. Meanwhile charged resetting spring or free wheel cam biasing means 104 biases driving lever 70 in the counterclockwise position but driving lever 70 is restrained from movement because first and second free rollers 114 and 116, respectively, rigidly link driving lever 70 with free wheel cam 80 which is restrained from moving by second stopping means 108.

Figure 8:
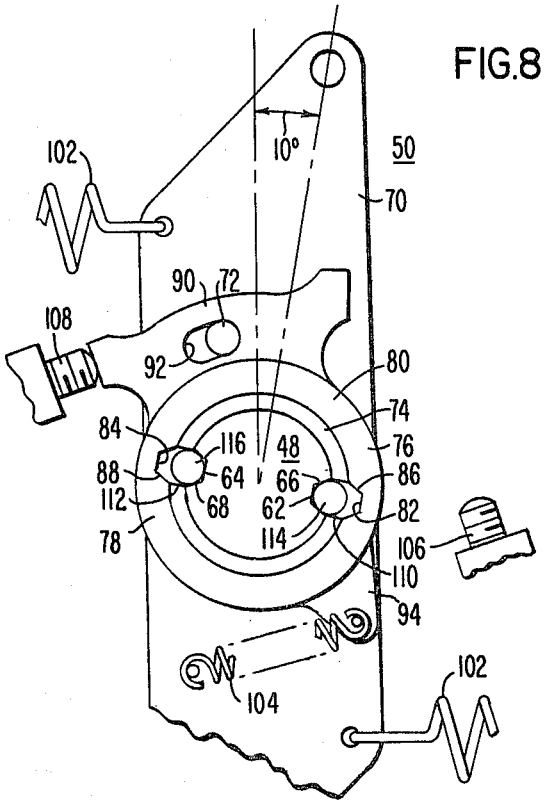
FIG. 8 is an enlarged elevational view of the mechanical timing means of FIG. 3 when the movement effecting means shaft has rotated in the counterclockwise direction corresponding to the opening operation of the main contacts of the interrupter and the driving lever is still in the 10° clockwise advanced position.
Figure 8A:
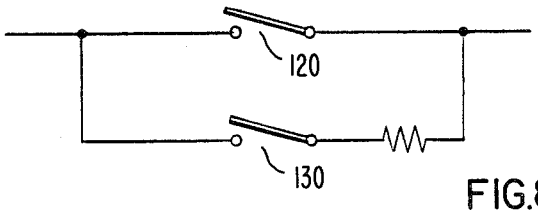
FIG. 8A is a schematic diagram showing the position of the main and impedance contacts corresponding to the position of the mechanical timing means of FIG. 8.

Referring now to FIGS. 8 and 8A, when movement effecting means 40 moves shaft 48 in the counterclockwise direction during the opening of the interrupter contacts 120, shaft 48 rotates in the counterclockwise direction until first and second shaft apertures 62 and 64, respectively, radially align with first and second driving lever and free wheel apertures 74, 76, 82 and 84, respectively, to recomplete first and second radial passageways 110 and 112, respectively. First and second free rollers 114 and 116, respectively, are now urged into rigidly linking shaft 48 with driving lever 70 by means of first and second transverse sides 86 and 88 of first and second free wheel apertures 82 and 84, respectively. The linked shaft 48 and driving lever 70 thus rotate concurrently the additional 10° in the counterclockwise direction and are restrained by driving lever restraining pin 72 reaching the far counterclockwise position within restraining aperture 92 to reeturn to the starting position shown in FIG. 4. As illustrated in FIGS. 8A and 4A, this 10° rotation places both the interrupter contacts 120 and impedance contacts 130 of circuit interrupter 10 in the full open position.

In conclusion, there has been disclosed circuit interrupter apparatus having a new and novel mechanical timing means mechanism for insuring positive rigid mechanical insertion of a closing resistor in parallel with the interrupter contacts a precise predetermined time during the closing operation of the circuit interrupter and reopening the impedance contacts a precise predetermined time after the closing of the interrupter contacts. Since the mechanical timing means mechanism of the invention utilizes only the rigid linkage of mechanical elements, the timing mechanism according to the teachings of the invention will operate as precisely and accurately on the infinite closing operation of the circuit interrupter as it will on the first closing operation. Although the mechanical timing means mechanism of the present invention was developed for the illustrated circuit interrupter application because the present invention solved certain problems relative to circuit interrupter closing resistor insertion operations, the invention is not to be construed as so limited. The invention, is broadly applicable to any apparatus wherein it is desirable to have a positive precise repeatable timing means for control of desirable operations.

What is claimed is:

1. A circuit interrupter comprising:

(a) a pair of cooperable, separable interrupter contacts, at least one of which is movable;

(b) a part of cooperable, separable impedance contacts, at least one of which is movable;

(c) impedance means adapted to be placed electrically in parallel with said interrupter contacts by said impedance contacts;

(d) means for effecting movement of said movable interrupter contact and said movable impedance contact to provide for opening and closing of said interrupter and impdance contacts, said movement effecting means including a rotatable shaft;

(e) mechanical timing means having rigid mechanical operative elements that are rotatively coupled to each other and to said rotatable shaft and, in response to the actuation of said movement effecting means and the rotative interaction between said mechanical operative elements and said shaft, are adapted to control the closing of said impedance contacts at a predetermined time interval relative to the closing of said interrupter contacts;

(f) an interrupter contact operating mechanism responsive to said movement effecting means and the rotation of said shaft for opening and closing said interrupter contacts; and (g) an impedance contact mechanism responsive to the rotative interaction between said rotatable shaft and the coupled mechanical operative elements of said mechanical timing means for closing and opening said impedance contacts in a predetermined time sequence that is controlled by said mechanical timing means and the coupled rotatable shaft of said movement effecting means.

2. The circuit interrupter of claim 1 wherein said predetermined time interval is approximately 10 milliseconds before the closing of said interrupter contacts occurs.

3. The circuit interrupter of claim 1 wherein the mechanical timing means is also adapted to reopening the impedance contacts at a second predetermined time interval relative to the closing of the interrupter contacts.

4. The circuit interrupter of claim 3 wherein the second predetermined time interval is two to three milliseconds.

5. The circuit interrupter of claim 1 wherein the rotatable shaft of said movement effecting means has at least a first aperture disposed therein; and the mechanical timing means includes a driving lever having a cylindrical protrusion with at least a second aperture disposed within said cylindrical protrusion, said driving lever being rotatably disposed on said movement effecting means shaft, a freewheel cam rotatably disposed upon said driving lever cylindrical protrusion having at least a third aperture disposed therein; a first biasing means biasing said driving lever in the direction which opens said impedance contacts, and a second biasing means for biasing said freewheel cam in the opposite direction, said shaft, first driving lever and freewheel cam being arranged such that said first, second and third apertures are situated within a common plane so as to form a first radial passageway when said first, second and third apertures are radially aligned; said mechanical timing means further including a free roller disposed within said first radial passageway; when said movement effecting means effects movement of said movable interrupter contact said movement effecting means shaft rotates said first aperture, and said second aperture of said movement effecting means shaft and said driving lever respectively, cooperates with said free roller to cause said impedance contact mechanism to close said impedance contacts said predetermined time before said interrupter contacts close; said first and second biasing means and said second and third apertures of said driving lever and said freewheel cam respectively cooperating with said free roller to cause said impedance contact mechanism to open said impedance contacts after a second predetermined time interval.

6. The circuit interrupter of claim 5 wherein the movement effecting means shaft has first and second apertures disposed therein, the driving lever has third and fourth apertures disposed therein, and the freewheel cam has fifth and sixth apertures disposed therein, said second, fourth and sixth apertures forming a second radial passageway when said first, third and fifth apertures form said first radial passageway and said second, fourth and sixth apertures cooperating with a second free roller whenever said first, third and fifth apertures cooperate with said first free roller.

7. The circuit interrupter of claim 6 wherein the driving lever further includes a restraining pin and the freewheel cam further includes a restraining aperture, said restraining pin being inserted within said restraining aperture, said restraining pin and aperture cooperating to keep said freewheel cam and said driving lever within a predetermined rotating relationship with each other.

8. The circuit interrupter of claim 7 wherein the freewheel cam further includes a restraining appendage and the mechanical timing means further includes first and second stopping means for stopping said restraining appendage and said freewheel cam at predetermined positions so as to determine said first and second predetermined time intervals.

9. The circuit interrupter of claim 1 wherein said mechanical timing means comprises;

a driving lever that is rotatably secured to the rotatable shaft of said movement effecting means, a freewheel cam that is rotatably secured to said driving lever, stop means for limiting the rotative movement of said driving lever and freewheel cam, and biasing means for returning the rotatable driving lever and freewheel cam to predetermined positions relative to one another and said rotatable shaft and thereby resetting the mechanical timing means.

10. The circuit interrupter of claim 9 wherein the rotative movement of said driving lever and freewheel cam relative to each other and to the rotatable shaft of said movement effecting means is also controlled by a free roller component that cooperates with apertures in said shaft, freewheel cam and driving lever and rigidly couples the driving lever to said shaft or freewheel cam, depending upon the relative positions of said apertures and their alignment.

* * * * *